US010646083B2

(12) United States Patent
Kim et al.

(10) Patent No.: US 10,646,083 B2
(45) Date of Patent: May 12, 2020

(54) VACUUM CLEANER WITH ANGLED WHEELS

(71) Applicant: SAMSUNG ELECTRONICS CO., LTD., Suwon-si (KR)

(72) Inventors: Dong Jun Kim, Suwon-si (KR); Kyoung Woung Kim, Suwon-si (KR); Do Kyung Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 252 days.

(21) Appl. No.: 15/593,741

(22) Filed: May 12, 2017

(65) Prior Publication Data

US 2017/0325646 A1 Nov. 16, 2017

(30) Foreign Application Priority Data

May 12, 2016 (KR) ..... 10-2016-0057930

(51) Int. Cl.

| | |
|---|---|
| ***A47L 5/36*** | (2006.01) |
| ***A47L 9/00*** | (2006.01) |
| ***A47L 9/04*** | (2006.01) |
| ***A47L 9/24*** | (2006.01) |
| ***A47L 9/06*** | (2006.01) |

(52) U.S. Cl.

CPC ..... *A47L 9/0477* (2013.01); *A47L 5/362* (2013.01); *A47L 9/009* (2013.01); *A47L 9/06* (2013.01); *A47L 9/244* (2013.01)

(58) Field of Classification Search

CPC ..... A47L 9/244; A47L 9/06; A47L 9/0477; A47L 9/009; A47L 5/362; A47L 11/4072; B60B 19/003

USPC ..... 16/18 A; 15/18 A

See application file for complete search history.

(56) References Cited

U.S. PATENT DOCUMENTS

| | | | | | |
|---|---|---|---|---|---|
| 1,318,881 | A | * | 10/1919 | Kelley | A47L 5/34 15/354 |
| 3,060,488 | A | * | 10/1962 | Skupas | B60B 33/0052 16/18 A |
| 3,768,114 | A | * | 10/1973 | Schwartz | A47L 9/02 15/319 |
| 4,105,083 | A | * | 8/1978 | Allen | E21B 10/18 175/313 |
| 4,195,700 | A | * | 4/1980 | Worden | E21B 10/18 175/313 |
| 4,457,045 | A | * | 7/1984 | Kegg | B60B 33/0042 16/18 A |

(Continued)

FOREIGN PATENT DOCUMENTS

| | | | | |
|---|---|---|---|---|
| GB | 757663 | A * | 9/1956 | B60B 19/14 |
| KR | 20090124940 | A * | 12/2009 | A47L 5/30 |
| WO | WO 2015/120835 | A1 | 8/2015 | |

*Primary Examiner* — Joseph J Hail
*Assistant Examiner* — Arman Milanian
(74) *Attorney, Agent, or Firm* — Staas & Halsey

(57) ABSTRACT

Disclosed is a vacuum cleaner having an improved structure for preventing hair or foreign substances from being caught in a wheel. The vacuum cleaner includes a suction nozzle having a suction passage for cleaning a surface to be cleaned by a suction force and a wheel assembly accommodated in the suction nozzle and configured to be rotatable. The wheel assembly includes a wheel and a rotating shaft to rotatably support the wheel. The rotating shaft is inclined relative to a bottom surface of the suction nozzle.

12 Claims, 9 Drawing Sheets

(56) References Cited

U.S. PATENT DOCUMENTS

| | | | | |
|---|---|---|---|---|
| 5,075,924 | A * | 12/1991 | Estkowski | B60B 33/0042 16/18 A |
| 7,950,102 | B2 * | 5/2011 | Lee | A47L 9/325 15/327.4 |
| 2001/0029641 | A1 * | 10/2001 | Uratani | A47L 5/362 15/327.4 |
| 2002/0185907 | A1 * | 12/2002 | Zimet | A47L 9/009 301/5.1 |
| 2007/0226937 | A1 * | 10/2007 | Courtney | A47L 9/009 15/246.4 |
| 2008/0065265 | A1 * | 3/2008 | Ozick | G05D 1/0231 700/245 |
| 2009/0165242 | A1 * | 7/2009 | Lee | A47L 5/28 15/411 |
| 2009/0200773 | A1 * | 8/2009 | Riddiford | A45C 3/04 280/651 |
| 2010/0257695 | A1 * | 10/2010 | Maguire | A47L 9/009 15/415.1 |
| 2012/0079676 | A1 * | 4/2012 | Sunderland | A47L 9/009 15/352 |
| 2013/0062843 | A1 * | 3/2013 | Riddiford | A45C 3/04 280/47.26 |
| 2013/0086768 | A1 * | 4/2013 | Nishimura | A47L 5/28 15/354 |
| 2014/0359967 | A1 * | 12/2014 | Park | A47L 9/10 15/347 |
| 2015/0059122 | A1 * | 3/2015 | Kim | A47L 5/28 15/354 |

* cited by examiner

VACUUM CLEANER WITH ANGLED WHEELS

CROSS-REFERENCE TO RELATED APPLICATIONS

This application claims the priority benefit of Korean Patent Application No. 10-2016-0057930, filed on May 12, 2016, in the Korean Intellectual Property Office, the disclosure of which is incorporated herein by reference.

BACKGROUND

1. Technical Field

Embodiments disclosed herein relate to a vacuum cleaner, and more particularly, to a vacuum cleaner having an improved structure for preventing hair or foreign substance from being caught in a wheel.

2. Description of the Related Art

Generally, a vacuum cleaner refers to an apparatus that generates a suction force to suck foreign substances, such as dust, together with air, and then removes the foreign substances by using a dust collecting device or the like provided inside a main body thereof.

The vacuum cleaner is divided into a canister-type cleaner and an upright-type cleaner. The canister-type cleaner includes a main body in which a blowing device and a dust collecting device are installed, a suction nozzle separated from the main body and configured to suction dust on the floor, and a connection pipe connecting the main body and the suction nozzle to each other.

Therefore, a user performs cleaning by holding a handle provided on the connection pipe and moving the suction nozzle in a direction to clean the floor.

In contrast, the upright-type cleaner includes an upright main body and a suction body integrally coupled to a lower portion of the main body. A user performs cleaning by holding a handle provided on the upper side of the main body and moving the entire main body of the upright-type cleaner.

In particular, a drum brush is mounted in a suction nozzle of the upright-type cleaner to improve cleaning efficiency. The drum brush separates the foreign substance attached to a surface to be cleaned by rotating at a high speed and coming into contact with the surface to be cleaned, and the separated foreign substance is sucked into the suction nozzle and then introduced into a dust collecting device provided in the main body.

However, foreign substance, such as hair, may be caught in a wheel mounted on the suction nozzle in a repeated use and thus inhibits the movement and rotation of the suction nozzle and the wheel, which may cause deterioration of the cleaning efficiency.

SUMMARY

Therefore, it is an aspect of the present disclosure to provide a vacuum cleaner capable of preventing hair or foreign substances from being caught in a wheel by improving a wheel structure mounted on a suction nozzle.

It is another aspect of the present disclosure to provide a vacuum cleaner capable of preventing foreign substances from being caught in a wheel by making a point contact such that a contact area with a floor surface is minimized during rotation of the wheel.

Additional aspects of the disclosure will be set forth in part in the description which follows and, in part, will be obvious from the description, or may be learned by practice of the disclosure.

In accordance with an aspect of the present disclosure, a vacuum cleaner includes a suction nozzle having a suction passage for cleaning a surface to be cleaned by a suction force and a wheel assembly accommodated in the suction nozzle and configured to be rotatable. The wheel assembly includes a wheel and a rotating shaft to rotatably support the wheel. The rotating shaft is inclined with respect to a bottom surface of the suction nozzle.

The wheel may include a hemispherical shape.

The rotating shaft may be inclined at an acute angle.

The rotating shaft may be disposed to face a center line passing through a center of a base of the suction nozzle.

The suction nozzle may include a base on which a suction port is formed and a cover coupled to the base to form the suction flow path therein. The base may include a wheel receiving portion to form a receiving space for receiving the wheel assembly.

The wheel receiving portion includes a first support provided to support a portion of the rotating shaft at a first angle, and a second support coupled to the first support and provided to support another portion of the rotating shaft.

The vacuum cleaner may further include a coupling member to detachably connect the first support and the second support.

The first support may include a first supporting surface formed at the first angle to support the portion of the rotating shaft and a first inclined surface to connect the first supporting surface and the base.

The second support may include a second supporting surface formed at the first angle to support the other portion of the rotating shaft.

The first inclined surface may be provided to be perpendicular to the rotating shaft.

In accordance with another aspect of the present disclosure, a vacuum cleaner includes a cleaner main body, a suction nozzle connected to the cleaner main body and configured to clean a surface to be cleaned by a suction force, and a wheel assembly. The wheel assembly includes a wheel rotatably mounted on the suction nozzle, a rotating shaft to rotatably support the wheel and inclined with respect to a bottom surface of the suction nozzle. The wheel assembly may include a first rotating part provided on one side of the suction nozzle and a second rotating part provided to face the first rotating part with respect to a center line passing through a center of the suction nozzle.

The first rotating part may include a first rotating shaft inclined at a first angle. The second rotating part may include a second rotating shaft inclined at the first angle. The first rotating shaft and the second rotating shaft may be disposed opposite to each other with respect to a direction toward the surface to be cleaned.

A distance between the first rotating shaft and the second rotating shaft may decrease toward the surface to be cleaned.

The wheel may include a hemispherical shape.

The suction nozzle may include a wheel receiving portion to form a receiving space for receiving the wheel assembly therein.

The wheel receiving portion may include a first support provided to support a portion of the rotating shaft and a second support provided to support another portion of the rotating shaft.

The first support may be provided on the bottom surface of the suction nozzle.

The second support may be detachably coupled to an upper portion of the first support.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, exemplary embodiments according to the present disclosure will be described in detail with reference to the accompanying drawings. The terms "front end", "rear end", "lower portion", "upper end" and "lower end" used in the following description are defined based on the drawings. The shape and position of each component should not be limited by these terms.

Figure 1:
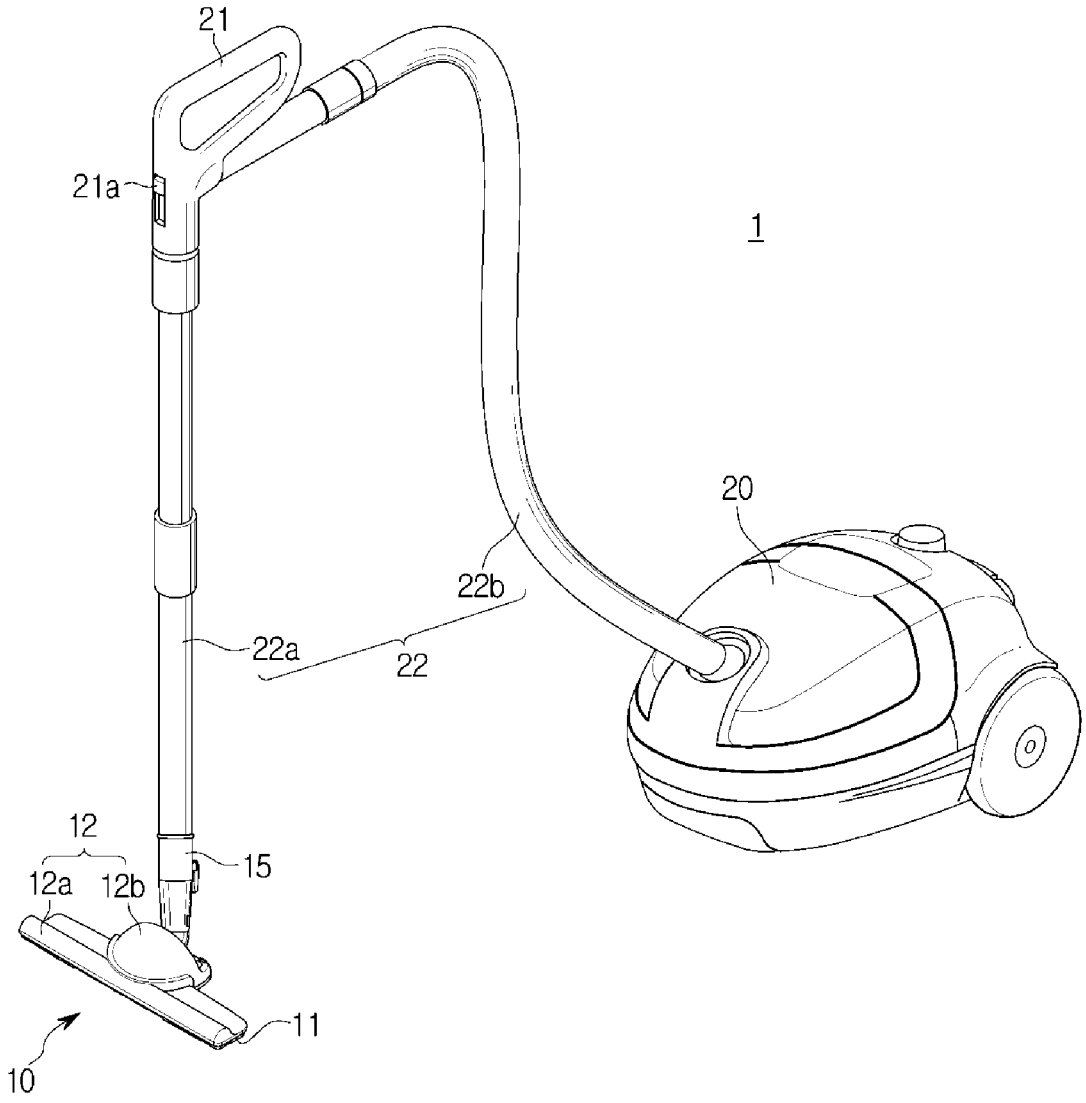
FIG. 1 is a view illustrating a vacuum cleaner according to an embodiment of the present disclosure.

FIG. 1 is a view illustrating a vacuum cleaner according to an embodiment of the present disclosure.

As illustrated in FIG. 1, a vacuum cleaner 1 includes a suction nozzle 10 provided to suction foreign substances on a surface to be cleaned (not shown, a floor F) by a suction force of air, a cleaner main body 20 provided to collect the foreign substances suctioned through the suction nozzle 10, and a connecting member 22 connecting the suction nozzle 10 to the cleaner main body 20.

The cleaner main body 20 may include a motor (not shown) to generate a suction force required to suction foreign substances on the surface to be cleaned and a dust collecting device (not shown) in which the foreign substances suctioned from the surface to be cleaned are accumulated.

The suction nozzle 10 is provided to suction foreign substances, such as dust, existing on the surface to be cleaned while making contact with the surface to be cleaned and moving.

The connecting member 22 connects the cleaner main body 20 to the suction nozzle 10 and is provided to move the foreign substances suctioned by the suction nozzle 10 to the cleaner main body 20.

The connecting member 22 may include a grip portion 21 arranged to be gripped and easily manipulated by a user, a first connecting pipe 22*a* connecting the grip portion 21 to the suction nozzle 10, and a second connecting pipe 22*b* connecting the grip portion 21 to the cleaner main body 20.

The grip portion 21 may be provided with a switch 21*a* for a user's manipulation. The user holds the grip portion 21 and manipulates the switch 21*a* to operate the motor while moving the cleaner main body 20 to suction dirt and foreign substance on the surface to be cleaned through the suction nozzle 10 and collect the dirt and foreign substance in the cleaner main body 20.

In the embodiment of the present disclosure, the first connecting pipe 22*a* is formed in a telescopic structure so that the length of the first connecting pipe 22*a* is variable, but the concept of the present disclosure is not limited thereto. The first connecting pipe may be formed in a single body.

The second connecting pipe 22*b* may include a flexible hose connecting the grip portion 21 and the cleaner main body 20. The flexible hose may be formed as a flexible wrinkle pipe. One end of the flexible hose is connected to the cleaner main body 20 and the other end of the flexible hose is connected to the grip portion 21 such that the suction nozzle 10 and the grip portion 21 connected to the suction nozzle 10 are freely moved around the cleaner main body 20 within a certain range.

Figure 2:
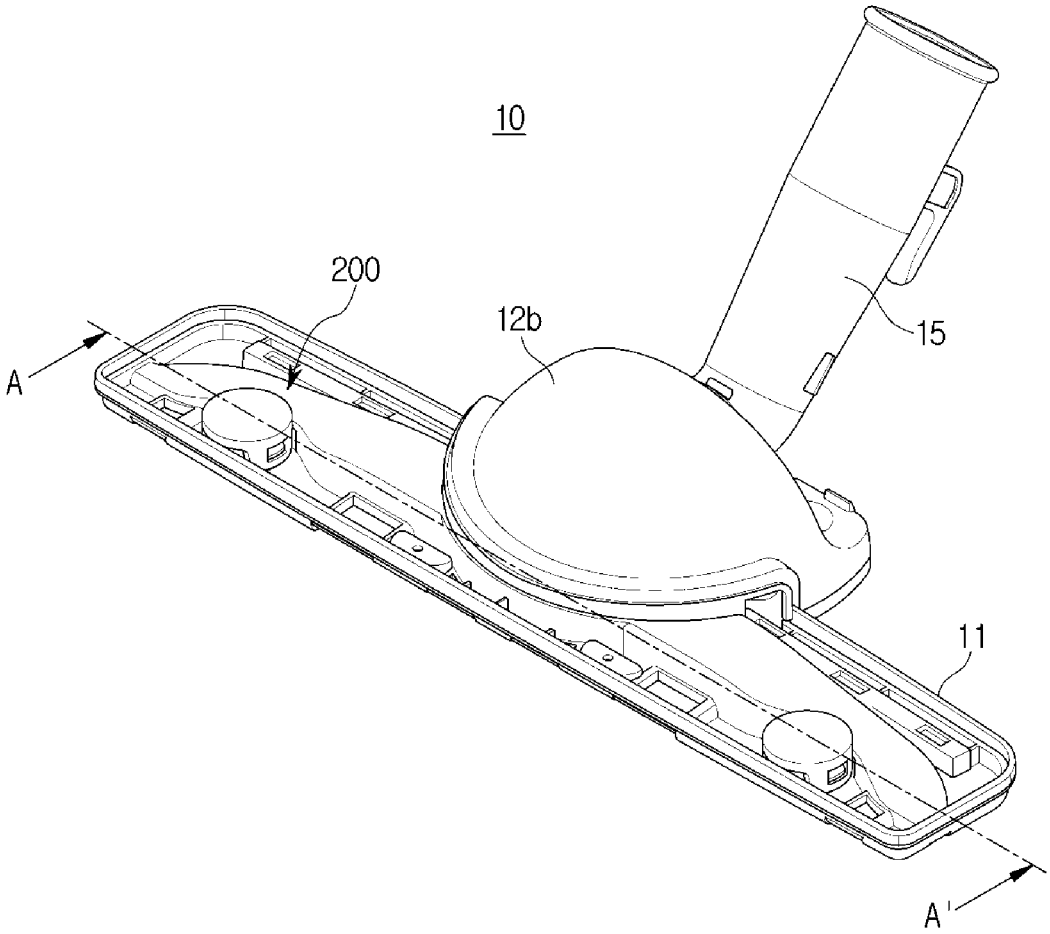
FIG. 2 is a view illustrating a suction nozzle of a vacuum cleaner according to an embodiment of the present disclosure.
Figure 3:
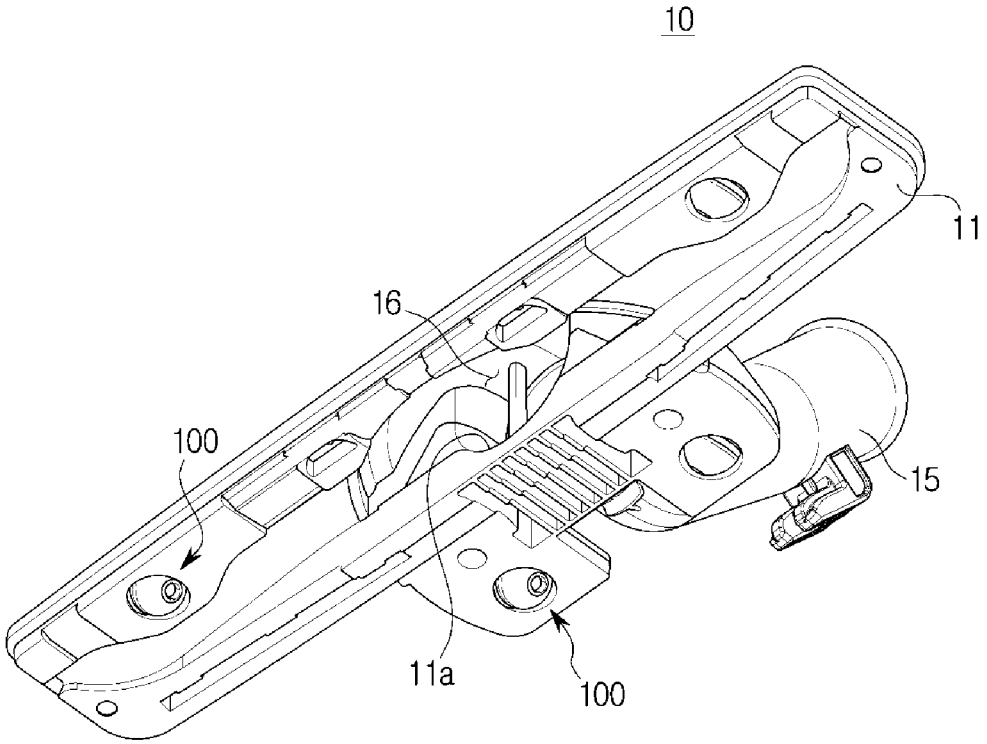
FIG. 3 is a bottom view illustrating a suction nozzle according to an embodiment of the present disclosure.

FIG. 2 is a view illustrating a suction nozzle of a vacuum cleaner according to an embodiment of the present disclosure and FIG. 3 is a bottom view illustrating a suction nozzle according to an embodiment of the present disclosure.

As illustrated in FIGS. 2 and 3, the suction nozzle 10 of the vacuum cleaner 1 is connected to a lower end of the first connecting pipe 22*a*. The suction nozzle 10 may be connected to the first connecting pipe 22*a* through a connecting bracket 15.

The suction nozzle 10 may include a base 11 arranged to form a bottom surface of the suction nozzle 10 and a cover 12 coupled to the base 11 to form a suction passage 16 for cleaning the surface to be cleaned by a suction force.

At least a portion of the base 11 may be provided with a suction port 11*a*. The suction port 11*a* may be formed at the center of the base 11. Air and foreign substances suctioned from the surface to be cleaned through the suction port 11*a* are transferred to the cleaner main body 20 through the suction passage 16 and removed.

The cover 12 may include a first cover 12*a* and a second cover 12*b*. The first cover 12*a* may form a front portion of the outer appearance of the base 11 and the second cover 12*b* may form a rear portion of the outer appearance of the base 11.

The second cover 12*b* is provided on the upper side of the suction port 11*a* of the base 11 to form the suction passage 16 with the base 11. Although the first cover 12*a* and the second cover 12*b* are separately provided and coupled to the base 11 in the embodiment of the present disclosure, the concept of the present disclosure is not limited thereto. For example, the first cover and the second cover may be integrally formed.

Although not shown, a drum brush may be installed in the suction port 11*a* of the base 11 to facilitate cleaning. The drum brush may be rotated inside the suction nozzle 10 to facilitate cleaning of the carpet.

The base 11 may be provided with a wheel assembly 100 arranged to move the suction nozzle 10. The wheel assembly 100 may be accommodated and rotatably installed in a wheel receiving portion 200 provided in the base 11. In the embodiment of the present disclosure, four wheel assemblies are disposed on the front left, front right, rear left and rear right sides of the base, respectively, but the present disclosure is not limited thereto. For example, the wheel assemblies may be provided as a pair of wheel assemblies such that the wheel assemblies are arranged on the left and right sides of the base, respectively.

Figure 4:
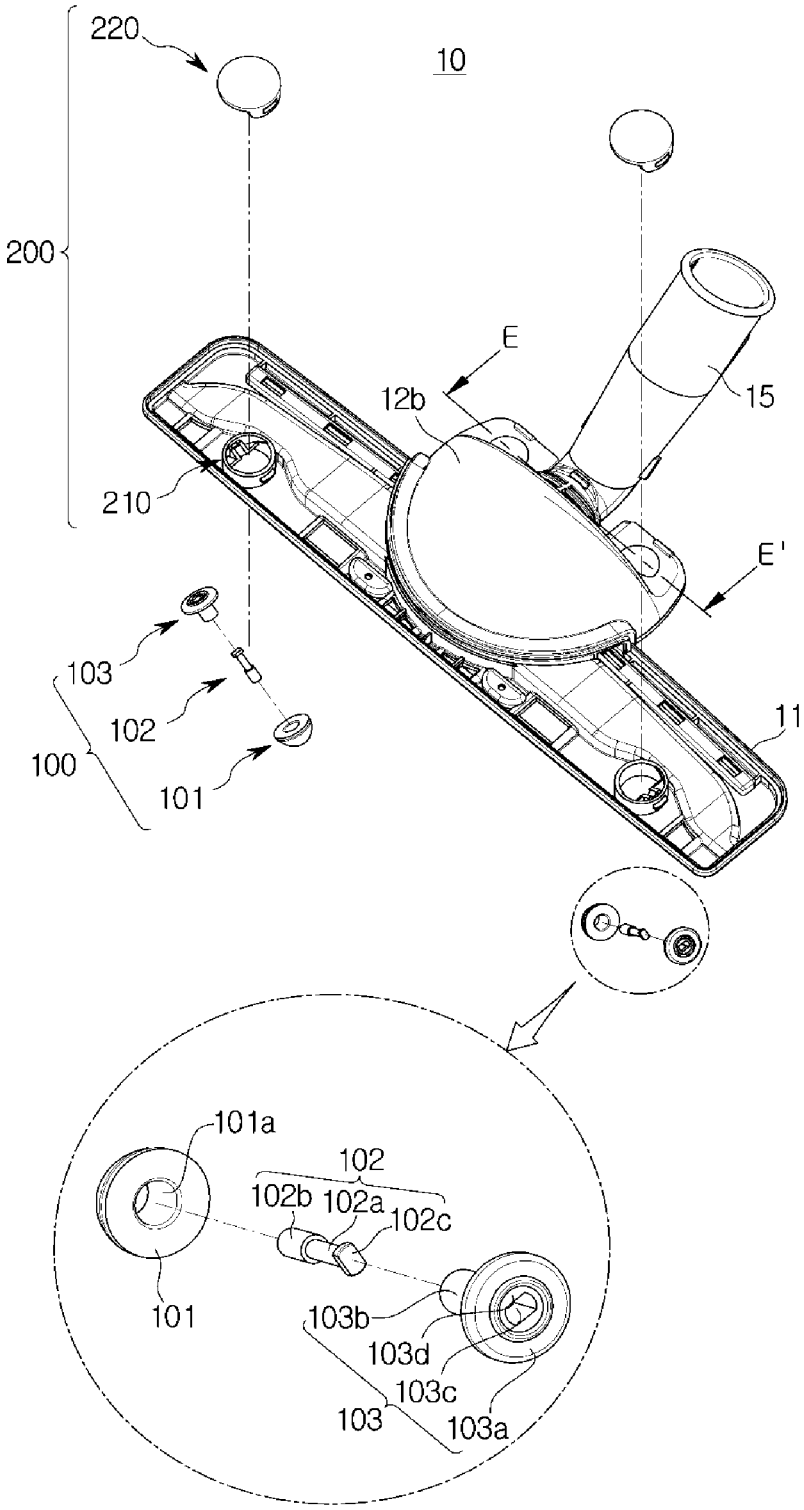
FIG. 4 is an exploded perspective view illustrating a wheel assembly mounted on a suction nozzle according to an embodiment of the present disclosure.
Figure 5:
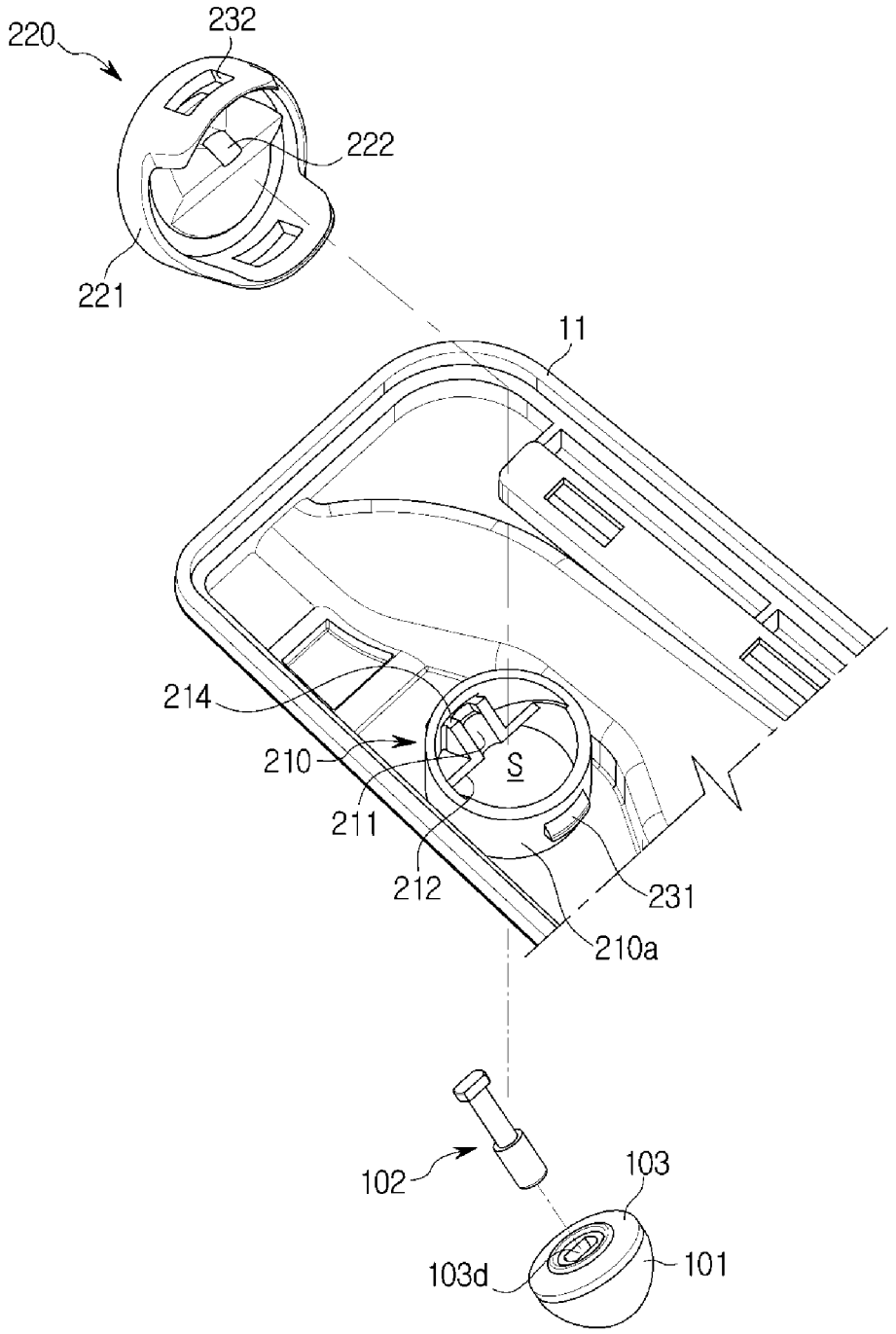
FIG. 5 is an exploded perspective view illustrating a wheel receiving portion of a suction nozzle and a wheel assembly according to an embodiment of the present disclosure.
Figure 6:
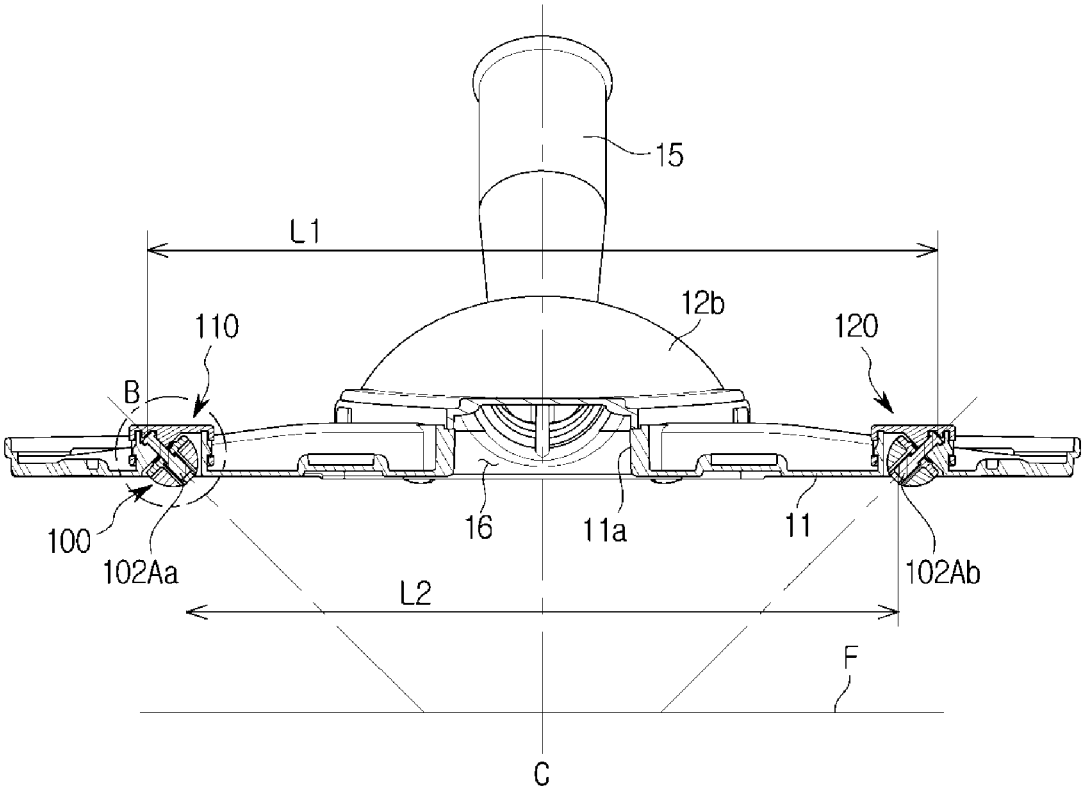
FIG. 6 is a schematic view illustrating a section taken along line A-A' of FIG. 2.
Figure 7:
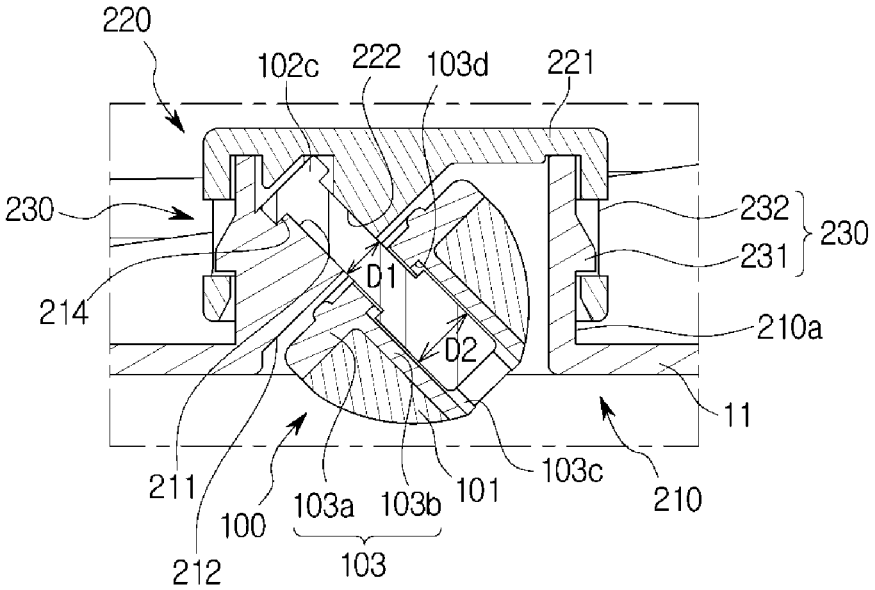
FIG. 7 is an enlarged cross-sectional view illustrating a portion B of FIG. 6.

FIG. 4 is an exploded perspective view illustrating a wheel assembly mounted on a suction nozzle according to an embodiment of the present disclosure, FIG. 5 is an exploded perspective view illustrating a wheel receiving portion of a suction nozzle and a wheel assembly according to an embodiment of the present disclosure, FIG. 6 is a schematic view illustrating a section taken along line A-A' of FIG. 2, and FIG. 7 is an enlarged cross-sectional view illustrating a portion B of FIG. 6.

As illustrated in FIGS. 4 to 7, the wheel assembly 100 rotatably installed in the suction nozzle 10 may include a wheel 101 and a rotating shaft 102 arranged to rotatably support the wheel 101.

The rotating shaft 102 may be inclined with respect to the bottom surface of the suction nozzle 10, that is, with respect to the base 11. The rotating shaft 102 may include a first body 102*a*, a second body 102*b* formed at one side of the first body 102*a*, and a third body 102*c* formed at the other side of the first body 102*a*.

The first body 102*a* of the rotating shaft 102 may include a cylindrical shape having a first diameter D1.

The third body 102*c* of the rotating shaft 102 may be formed at the upper end of the first body 102*a*. The third body 102*c* is provided to fix the rotating shaft 102 to the wheel receiving portion 200 of the base 11, which will be described later. The third body 102*c* may have a size larger than the first diameter D1 of the first body 102*a*. Although the third body 102*c* has a rectangular shape in the embodiment of the present disclosure, the concept of the present disclosure is not limited thereto. For example, the third body may have various shapes including circular and elliptical shape having a length greater than the first diameter of the first body.

The second body 102*b* of the rotating shaft 102 may be formed at the lower end of the first body 102*a*. The second body 102*b* may include a cylindrical shape having a second diameter D2. The second diameter D2 of the second body 102*b* may have a size larger than the first diameter D1 of the first body 102*a*.

The wheel 101 of the wheel assembly 100 may include a hemispherical shape. A coupling groove 101*a* coupled to the rotating shaft 102 may be formed at the center of the wheel 101. A wheel bracket 103 may be coupled to the coupling groove 101*a* of the wheel 101. The wheel 101 may include the wheel bracket 103 provided for engagement with the rotating shaft 102.

The wheel bracket 103 may include a first bracket 103*a* having a disc shape and a second bracket 103*b* protruding to one side from the center of the first bracket 103*a*. The first bracket 103*a* may be coupled to the upper surface of the hemispherical wheel 101.

The second bracket 103*b* may be formed as a hollow so that the rotating shaft 102 is coupled to the second bracket 103*b*. The second bracket 103*b* may include a hollow portion 103*c* inside the second bracket 103*b* so that the rotating shaft 102 is coupled to the hollow portion 103*c*.

The second bracket 103*b* of the wheel bracket 103 is inserted into the coupling groove 101*a* of the wheel 101, and the second body 102*b* of the rotating shaft 102 is inserted into the hollow portion 103*c* of the second bracket 103*b*.

The first bracket 103*a* may be provided with a separation preventing portion 103*d* to prevent the second bracket 103*b* from being separated from the rotating shaft 102. The separation preventing portion 103*d* may be provided at the end of the hollow portion 103*c* of the second bracket 103*b*. The separation preventing portion 103*d* may protrude toward the center from the end of the hollow portion 103*c* of the second bracket 103*b* in a linear shape. The separation preventing portion 103*d* may have a shape corresponding to the third body 102*c* of the rotating shaft 102.

The third body 102*c* of the rotating shaft 102 may pass through the second bracket 103*b* through the separation preventing portion 103*d*, and the second body 102*b* of the rotating shaft 102 may be couple to the hollow portion 103*c* of the second bracket 103*b*.

The wheel receiving portion 200 for rotatably receiving the wheel assembly 100 may be provided on the base 11. The wheel receiving portion 200 may be integrally formed with at least a portion of the base 11. The wheel receiving portion 200 may include a first support 210 provided to rotatably support the rotating shaft 102, and a second support 220 coupled to the first support 210 and provided to rotatably support the rotating shaft 102. Although the first support and the second support are separately provided and joined each other in the embodiment of the present disclosure, the spirit of the present disclosure is not limited thereto.

The wheel receiving portion 200 may include a receiving space S formed between the first support 210 and the second support 220 to receive the wheel assembly 100.

The first support 210 may include a first supporting body 210*a* forming an outer appearance thereof, a first supporting surface 211 provided inside the first supporting body 210*a*, and a first inclined surface 212 extending from the first supporting surface 211.

The first supporting body 210*a* of the first support 210 may be formed in a cylindrical shape so as to receive the wheel assembly 100. The first support 210 of the wheel receiving portion 200 is provided to support at least a portion of the rotating shaft 102 at a first angle θ1. The first angle θ1 is an angle formed between the bottom surface of the base 11 and the rotating shaft 102. The first angle θ1 may be formed at an acute angle. The first angle θ1 may be formed to satisfy $\theta \leq \theta 1 \leq 90$.

The first support 210 may protrude upward from the base 11 to form the receiving space S. The first support 210 may include a first supporting body 210*a* connected to the base 11. The first support 210 may include a cylindrical first support body 210*a* formed in a hollow shape. The first support 210 may include a first supporting surface 211 formed at a first angle θ1 to support a portion of the rotating shaft 102 and a first inclined surface 212 connecting between the first supporting surface 211 and the base 11. The first supporting surface 211 may be inclined at the first angle θ1. The first supporting surface 211 and the first inclined surface 212 may be provided in the receiving space S. A first supporting end 214 may be provided at an end of the first supporting surface 211 so that the third body 102*c* of the rotating shaft 102 is supported.

Accordingly, the rotating shaft 102 is installed in the receiving space S of the first support 210 so that at least a portion of the first body 102*a* is supported by the first supporting surface 211 at the first angle θ1. The third body 102*c* of the rotating shaft 102 is supported by the first supporting end 214 to prevent the rotating shaft 102 from being separated from the first supporting surface 211.

The rotating shaft 102 is obliquely installed on the first supporting surface 211 of the first support 210 at the first angle θ1 and the wheel 101 is rotated with respect to the surface to be cleaned. The wheel 101 has a minimum contact area with the surface to be cleaned due to the inclined rotating shaft 102, and thus foreign matter such as hair on the surface to be cleaned may be prevented from being caught in the wheel 101.

In addition, a rotating portion of the rotating shaft 102 may be prevented from being exposed toward the surface to be cleaned by the first supporting surface 211 of the wheel receiving portion 200.

Another portion of the rotating shaft 102 may be supported by the second support 220 coupled to the first support 210. The second support 220 is arranged to form the receiving space S between the first support 210 and the second support 220. The second support 220 may be formed on a wheel accommodating portion cap 221. The wheel accommodating portion cap 221 may be formed in a circular shape. The wheel accommodating portion cap 221 may be formed in a size and shape corresponding to the first support 210. The second support 220 may include a second supporting surface 222 formed to support the remaining portion of the rotating shaft 102. The second supporting surface 222 may be inclined at the first angle θ1. The second supporting surface 222 may be provided inside the receiving space S.

The rotating shaft 102 is installed in the receiving space S of the second support 220 so that at least a portion of the first body 102*a* is supported by the second supporting surface 222 at the first angle θ1. The rotating shaft 102 is obliquely supported on the second supporting surface 222 of the second support 220 at the first angle θ1. The wheel 101 has a minimum contact area with the surface to be cleaned due to the inclined rotating shaft 102, and thus foreign substance such as hair on the surface to be cleaned may be prevented from being caught in the wheel 101.

The first support 210 and the second support 220 may further include a coupling member 230 detachable from the first support 210 and the second support 220. The coupling member 230 may include a first coupling member 231 provided on the first support 210 and a second coupling member 232 provided on the second support 220.

The first coupling member 231 is formed on the first supporting body 210*a* of the first support 210. The first coupling member 231 may include a protrusion protruding from an outer circumferential surface of the first support 210. The first coupling member 231 may include at least one hook protruding from an outer surface of the first supporting body 210*a*.

The second coupling member 232 is formed on the wheel receiving portion cap 221 of the second support 220. The second coupling member 232 may include a hole formed by cutting a portion of the wheel accommodating portion cap 221. The second coupling member 232 may be formed in a shape corresponding to a shape of the first coupling member 231.

The first support portion 210 and the second support portion 220 may stably support the rotating shaft 102 by the engagement of the first coupling member 231 and the second coupling member 232.

As shown in FIG. 6, the wheel assembly 100 may be installed on each side of a center line C passing through the center of the base 11. The two wheel assemblies 100 may be provided as a pair. The wheel assembly 100 may include a first rotating part 110 disposed at one side of the base 11 and a second rotating part 120 disposed at the other side of the base 11.

The first rotating part 110 includes a first rotating shaft 102Aa inclined at a first angle θ1, the second rotating part 120 includes a second rotating shaft 102Ab inclined at the first angle θ1, and the first rotating shaft 102Aa and the second rotating shaft 102Ab are disposed opposite to each other with respect a direction toward the surface to be cleaned.

The distance between the first rotating shaft 102Aa of the first rotating part 110 and the second rotating shaft 102Ab of the second rotating part 120 becomes narrower toward the surface to be cleaned.

A first distance L1 between the first rotating shaft 102Aa and the second rotating shaft 102Ab may be longer than a second distance L2 between the first rotating shaft 102Aa and the second rotating shaft 102Ab. The first distance L1 may include a distance between the third bodies 102*c* of the rotating shafts 102 and the second distance L2 may include a distance between the second bodies 102*b* of the rotating shafts 102. The first rotating shaft 102Aa and the second rotating shaft 102Ab are symmetrically disposed with respect to the center line C.

Figure 8:
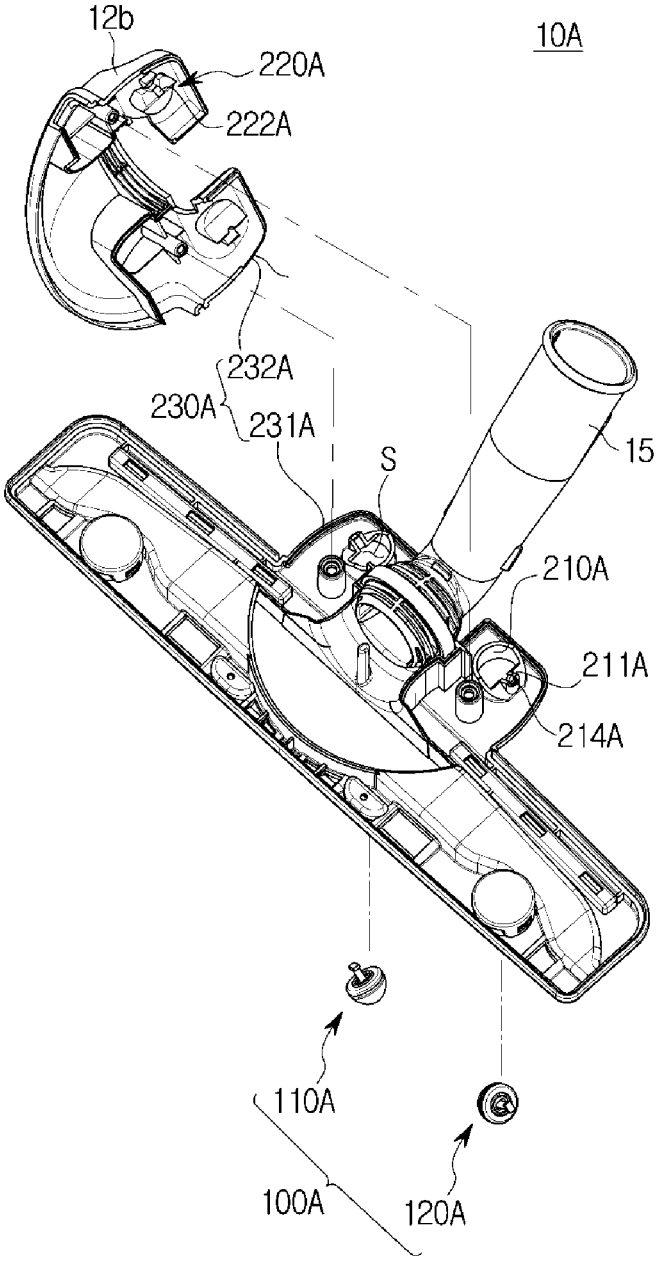
FIG. 8 is an exploded perspective view illustrating a wheel assembly mounted on a suction nozzle according to another embodiment of the present disclosure.
Figure 9:
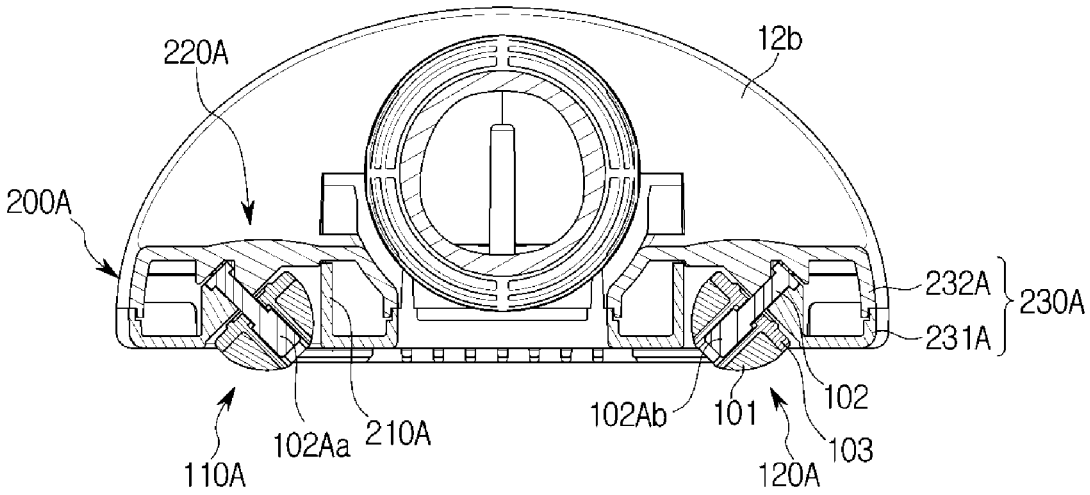
FIG. 9 is a cross-sectional view illustrating a section taken along line E-E' in FIG. 4.

FIG. 8 is an exploded perspective view illustrating a wheel assembly mounted on a suction nozzle according to another embodiment of the present disclosure and FIG. 9 is a cross-sectional view illustrating a section taken along the line E-E' in FIG. 4. Reference numerals not shown refer to FIGS. 1 to 7.

As illustrated in FIGS. 8 and 9, a wheel receiving portion 200A may include a first support 210A and a second support 220A. The first support 210A may be formed on the base 11.

The first support 210A may include a first supporting body 210*a* connected to the base 11, a first supporting surface 211A formed at a first angle θ1 in the first supporting body 210*a*, and a first inclined surface 212 connecting the first supporting surface 211A and the base 11. The first supporting surface 211A and the first inclined surface 212 may be provided in the receiving space S. A first supporting end 214A may be provided at an end of the first supporting surface 211A so that the third body 102*c* of the rotating shaft 102 is supported on the first supporting end 214A.

Accordingly, the rotating shafts 102Aa and 102Ab are installed such that at least a portion of the first body 102*a* is supported by the first supporting surface 211A at the first angle θ1 in the receiving space S of the first support 210A. The third bodies 102*c* of the rotating shafts 102Aa and 102Ab are supported by the first supporting ends 214A to prevent the corresponding rotating shaft from being separated from the first supporting surface 211A.

The second support 220A may be integrally formed with a second cover 12*b* of a suction nozzle 10A. The second support 220A may protrude from an inner surface of the second cover 12*b*. The second support 220A may include a second supporting surface 222A formed at a first angle θ1. The second supporting surface 222A of the second support 220A is provided to form a receiving space S with the first support 210A. The second support 220A may include a second supporting surface 222A formed to support the remaining part of the rotating shaft 102Aa or 102Ab which is not supported by the first supporting surface 211A. The second supporting surface 222A may be inclined at the first angle θ1. The second supporting surface 222A may be provided inside the receiving space S.

At least a portion of the first body 102*a* is supported by the second supporting surface 222A at the first angle θ1 in the receiving space S of the second support 220A. The rotating shafts 102Aa and 102Ab are obliquely supported on the corresponding second supporting surface 222A of the second supports 220A at the first angle 101.

The rotating shafts 102Aa and 102Ab may include a first rotating shaft 102Aa provided on a first rotating part 110A disposed at one side with respect to the center line C of the base 11, and a second rotating shaft 102Ab provided on a second rotating part 120A disposed at the other side of the center line C of the base 11. The first rotating shaft 102Aa and the second rotating shaft 102Ab are arranged to face each other with respect to the center line C. The wheels 101 installed to be inclined by the first rotating shaft 102Aa and the second rotating shaft 102Ab have minimum contact areas with the surface to be cleaned to prevent foreign substance, such as hair on the surface to be cleaned, from being caught in the wheels 101.

The first support 210A and the second support 220A may be coupled to each other by a coupling member 230A. The coupling member 230A may include a first coupling member 231A provided on the base 11 and a second coupling member 232A provided on the second cover 12*b*. When the base 11 and the second cover 12*b* are coupled to each other through the first coupling member 231A and the second coupling member 232A, the first support 210A and the second support 220A are engaged with each other to form the wheel receiving portion 200A.

As is apparent from the above description, in accordance with embodiments of the present disclosure, hair or foreign substances can be prevented from being caught in a wheel by improving a wheel structure mounted on a suction nozzle.

Also, the cleaning efficiency can be enhanced by making point contact such that a contact area of the wheel with a floor surface is minimized during rotation of the wheel to prevent foreign substances, such as hair, from being caught in the wheel.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A vacuum cleaner comprising:

a suction nozzle having a suction passage for cleaning a surface to be cleaned by a suction force; and a wheel assembly accommodated in the suction nozzle and configured to be rotatable, wherein the wheel assembly includes a wheel and a shaft to rotatably support the wheel, the shaft inclined with respect to a bottom surface of the suction nozzle, the suction nozzle includes a base on which a suction port is formed, the base includes a wheel receiving portion to form a receiving space for receiving the wheel assembly, the wheel receiving portion includes:

a first support provided to support a portion of the shaft at a first angle, and a second support coupled to the first support and provided to support another portion of the shaft, the first support includes a first supporting surface formed at the first angle to support the portion of the shaft and a first inclined surface connecting the first supporting surface and the base, and the wheel includes a hemispherical shape.

2. The vacuum cleaner according to claim 1, wherein the shaft is inclined at an acute angle.

3. The vacuum cleaner according to claim 1, wherein the shaft is disposed to face a center line passing through a center of the base of the suction nozzle.

4. The vacuum cleaner according to claim 1, wherein the suction nozzle includes a cover coupled to the base to form the suction passage therein.

5. The vacuum cleaner according to claim 1, further comprising a coupling member to detachably connect the first support and the second support.

6. The vacuum cleaner according to claim 1, wherein the second support includes a second supporting surface formed at the first angle to support the another portion of the shaft.

7. The vacuum cleaner according to claim 1, wherein the first inclined surface is provided to be perpendicular to the shaft.

8. A vacuum cleaner comprising:

a cleaner main body;

a suction nozzle connected to the cleaner main body and configured to clean a surface to be cleaned by a suction force; and a wheel assembly including a wheel rotatably mounted on the suction nozzle, and a shaft configured to rotatably support the wheel and inclined with respect to a bottom surface of the suction nozzle, wherein the wheel assembly includes a first rotating part provided on one side of the suction nozzle and a second rotating part provided to face the first rotating part with respect to a center line passing through a center of the suction nozzle, the suction nozzle includes a wheel receiving portion configured to form a receiving space for receiving the wheel assembly therein, the wheel receiving portion includes a first support provided to support a portion of the shaft and a second support provided to support another portion of the shaft, and the second support is detachably coupled to an upper portion of the first support, the wheel includes a hemispherical shape.

9. The vacuum cleaner according to claim 8, wherein the first rotating part includes a first shaft inclined at a first angle, the second rotating part includes a second shaft inclined at the first angle, and the first shaft and the second shaft are disposed opposite to each other with respect to a direction toward the surface to be cleaned.

10. The vacuum cleaner according to claim 9, wherein a distance between the first shaft and the second shaft decreases toward the surface to be cleaned.

11. The vacuum cleaner according to claim 8, wherein the wheel receiving portion is formed by recessing at least a portion of the bottom surface of the suction nozzle.

12. The vacuum cleaner according to claim 8, wherein the first support is provided on the bottom surface of the suction nozzle.

* * * * *